US009836950B2

(12) United States Patent
Levchenko et al.

(10) Patent No.: US 9,836,950 B2
(45) Date of Patent: Dec. 5, 2017

(54) HAND HYGIENE COMPLIANCE

(71) Applicant: UNIVERSITY HEALTH NETWORK, Toronto (CA)

(72) Inventors: Oleksandr Igorovich Levchenko, Mississauga (CA); Steven Michael Pong, Etobicoke (CA); Geoffrey Roy Fernie, Etobicoke (CA)

(73) Assignee: University Health Network (CA)

( * ) Notice: Subject to any disclaimer, the term of this patent is extended or adjusted under 35 U.S.C. 154(b) by 0 days.

(21) Appl. No.: 14/911,067

(22) PCT Filed: Aug. 12, 2014

(86) PCT No.: PCT/CA2014/000615

§ 371 (c)(1),
(2) Date: Feb. 9, 2016

(87) PCT Pub. No.: WO2015/021528

PCT Pub. Date: Feb. 19, 2015

(65) Prior Publication Data

US 2016/0180695 A1 Jun. 23, 2016

Related U.S. Application Data

(60) Provisional application No. 61/865,004, filed on Aug. 12, 2013.

(51) Int. Cl.

| | |
|---|---|
| ***G08B 23/00*** | (2006.01) |
| ***G08B 21/24*** | (2006.01) |
| ***G07C 9/00*** | (2006.01) |

(52) U.S. Cl.

CPC ..... *G08B 21/245* (2013.01); *G07C 9/00111* (2013.01)

(58) Field of Classification Search

CPC ..... G08B 21/245; G08B 21/24; G06Q 50/22; G06Q 10/06; G06Q 30/018; G06Q 10/0633; G06Q 10/087; G06Q 10/063114; G06Q 50/24; G07C 9/00111; G07C 1/10; G02B 2027/014; G02B 2027/0178; G02B 27/017

USPC ..... 340/573.1, 539.12, 539.11, 286.07, 340/309.16, 691.6, 692, 539.13

See application file for complete search history.

(56) References Cited

U.S. PATENT DOCUMENTS

| | | | |
|---|---|---|---|
| 3,478,344 | A | 11/1969 | Schwitzgebel |
| 3,696,384 | A | 10/1972 | Lester |
| 3,739,329 | A | 6/1973 | Lester |
| 4,275,385 | A | 6/1981 | White |
| 4,606,085 | A | 8/1986 | Davies |
| 4,709,330 | A | 11/1987 | Yokoi et al. |

(Continued)

FOREIGN PATENT DOCUMENTS

| | | |
|---|---|---|
| WO | WO2008/119158 | 10/2008 |
| WO | WO2010/034125 | 4/2010 |

OTHER PUBLICATIONS

BioVigil Industries, http://www.earthtimes.org/articles/show/biovigil-releases-secondgeneratio-n-hand-hygiene-monitoring-system, 1206560.shtml.

(Continued)

*Primary Examiner* — Daniel Previl
(74) *Attorney, Agent, or Firm* — Barnes & Thornburg LLP

(57) ABSTRACT

Disclosed herein are different embodiments of a hand hygiene compliance system, beacon, wearable monitor and kit.

27 Claims, 8 Drawing Sheets

(56) References Cited

U.S. PATENT DOCUMENTS

| | | | | |
|---|---|---|---|---|
| 4,722,372 | A | 2/1988 | Hoffman et al. | |
| 4,896,144 | A | 1/1990 | Bogstad | |
| 4,946,072 | A | 8/1990 | Albert et al. | |
| 4,952,928 | A | 8/1990 | Carroll et al. | |
| 4,990,892 | A | 2/1991 | Guest et al. | |
| 5,202,666 | A | 4/1993 | Knippscheer | |
| 5,204,670 | A | 4/1993 | Stinton | |
| 5,414,405 | A | 5/1995 | Hogg et al. | |
| 5,455,851 | A | 10/1995 | Chaco et al. | |
| 5,610,589 | A | 3/1997 | Evans et al. | |
| 5,670,945 | A | 9/1997 | Applonie | |
| 5,695,091 | A | 12/1997 | Winings et al. | |
| 5,793,653 | A | 8/1998 | Segal | |
| 5,798,714 | A | 8/1998 | Nyfelt | |
| 5,812,059 | A | 9/1998 | Shaw et al. | |
| 5,870,015 | A | 2/1999 | Hinkel | |
| 5,900,067 | A | 5/1999 | Jones | |
| 5,917,425 | A | 6/1999 | Crimmins et al. | |
| 5,945,910 | A | 8/1999 | Gorra | |
| 5,952,924 | A | 9/1999 | Evans et al. | |
| 5,954,069 | A | 9/1999 | Foster | |
| 5,960,991 | A | 10/1999 | Ophardt | |
| 6,125,482 | A | 10/2000 | Foster | |
| 6,236,317 | B1 | 5/2001 | Cohen et al. | |
| 6,236,953 | B1 | 5/2001 | Segal | |
| 6,278,372 | B1 | 8/2001 | Velasco, Jr. et al. | |
| 6,375,038 | B1 | 4/2002 | Daansen et al. | |
| 6,392,546 | B1 | 5/2002 | Smith | |
| 6,426,701 | B1 | 7/2002 | Levy et al. | |
| 6,524,390 | B1 | 2/2003 | Jones | |
| 6,577,240 | B2 | 6/2003 | Armstrong | |
| 6,727,818 | B1 | 4/2004 | Wildman et al. | |
| 6,882,278 | B2 | 4/2005 | Winings et al. | |
| 6,975,231 | B2 | 12/2005 | Lane et al. | |
| 6,982,639 | B2 | 1/2006 | Brackett et al. | |
| 7,015,816 | B2 | 3/2006 | Wildman et al. | |
| 7,242,307 | B1 | 7/2007 | LeBlond et al. | |
| 7,271,728 | B2 | 9/2007 | Taylor et al. | |
| 7,286,057 | B2 | 10/2007 | Bolling | |
| 7,482,936 | B2 | 1/2009 | Bolling | |
| 7,605,704 | B2 | 10/2009 | Munro et al. | |
| 7,818,083 | B2 | 10/2010 | Glenn et al. | |
| 7,825,812 | B2 | 11/2010 | Ogrin et al. | |
| 7,855,651 | B2 | 12/2010 | LeBlond et al. | |
| 8,237,558 | B2 * | 8/2012 | Seyed Momen | G01S 1/70 222/23 |
| 2002/0000449 | A1 | 1/2002 | Armstrong | |
| 2002/0135486 | A1 | 9/2002 | Brohagen et al. | |
| 2003/0019536 | A1 | 1/2003 | Smith | |
| 2003/0030562 | A1 | 2/2003 | Lane et al. | |
| 2004/0090333 | A1 | 5/2004 | Wildman et al. | |
| 2004/0138631 | A1 | 7/2004 | Harper | |
| 2004/0150527 | A1 | 8/2004 | Harper et al. | |
| 2004/0236470 | A1 | 11/2004 | Dooley et al. | |
| 2006/0132316 | A1 | 6/2006 | Wildman et al. | |
| 2007/0008146 | A1 | 1/2007 | Taylor et al. | |
| 2007/0015552 | A1 | 1/2007 | Bolling | |
| 2007/0213877 | A1 | 9/2007 | Hart et al. | |
| 2007/0222554 | A1 | 9/2007 | Hart | |
| 2008/0001763 | A1 | 1/2008 | Raja et al. | |
| 2010/0262430 | A1 | 10/2010 | Gips et al. | |
| 2012/0212582 | A1 * | 8/2012 | Deutsch | G08B 21/245 348/46 |
| 2012/0256742 | A1 * | 10/2012 | Snodgrass | G06F 19/327 340/539.12 |
| 2014/0009292 | A1 * | 1/2014 | Long | H04Q 9/00 340/573.1 |
| 2015/0221208 | A1 * | 8/2015 | Knighton | G08B 21/245 340/573.1 |

OTHER PUBLICATIONS

Bleak et al, An innovative method of measuring and improving hand hygiene adherence using a personal point of care, 2007, California.

Boscart and Levchenko, Advanced technology . . . clinical setting. International Conference & Workshops RNAO, 'Nurses: The Solution . . . Transformation', Oct. 2008, Beijing, China.

Boscart et al, Acceptability of a wearable hand wash device with monitoring capabilities, J Hosp Infect, 2008, pp. 216-222, vol. 70.

Boscart et al, Advanced technologies to curb healthcare-associated infections. Invited commentary Healthcare Papers, 2009, pp. 51-55, vol. 9(3).

Boscart et al, Automated hand hygiene monitoring: perspectives for healthcare staff, management, and infection control specialists, J Europ Assoc Hosp Manage 2009, pp. 15-16.

Boscart et al, Defining the configuration of a hand hygiene monitoring system. American journal of Infection Control, 2010 (in press).

Boscart et al, Hand hygiene compliance . . . healthcare staffInstitute for Healthcare Improvement's National Forum on Quality Improvement in Health Care, Apr. 2009, Canada.

Boscart et al, Testing of a portable . . . in the clinical setting. Health Professions Education, Global Best Practices in Simulation, May 2009, Toronto Canada.

CBC News, Electronic handwashing tool could curb superbug spread, http://www.cbc,ca/health/story/2008/03/03/handwashing-system.html, Mar. 3, 2008, Toronto.

Chagpar, A Human Factors Approach to Hand Hygiene, PowerPoint presentation for the University Health Network, 2008, Toronto.

CTV News, Device reminds health workers to wash hands, http://www.ctv.ca/servlet/ArticleNews/story/CTVNews/20080303/hand, 2008, Toronto.

Fernie et al, Technology to reduce institutional cross-infection rates . . . , 6th Conference of the International Society for Gerontechnology, May 20-23, 2008 Pisa, Italy.

Harbor Medical, Inc., The Sprixx Hand Hygiene System, 2007, www.sprixx.com/shhsoverview.html, Harbor Medical, Inc., CA, USA.

Kryski, Infection control: Protection through Prevention, Long Term Care, Jun./Jul. 2008, pp. 19-20, vol. 18(2).

Kuttenkuler, Hand Hygiene Monitor Tested at VCU Medical, http://www.news.vcu.edu/news/Hand.sub.--Hygiene.sub.--Monitor.sub.--Teste-d.sub.--at.sub.--VCU.sub.--Medical.sub.--Center, Sep. 16, 2009, VCU Communications.

Levchenko et al, Distributed IR based technology to monitor hand hygiene of healthcare staff, IEEE TIC STH, 2009, p. 252-255.

Levchenko et al, Embedded system for hygiene compliance monitoring, IEEE Transactions on Automation Science and Engineering, 2009, (in press).

Levchenko et al., "Hand Hygiene Monitoring . . . "*Systems Conference* (*SysCon*), 2012 IEEE international. IEEE, 2012.

Naya et al, Workers' routine activity recognition using body movements and location information, Wearable Computers, 10th IEEE International Symposium, 2006 p. 105-108.

Priest, After the beep, please record your hand hygiene, http://www.theglobeandmail.com/servlet/story/RTGAM.20080303., Mar. 3, 2008, Toronto, Phillip Crawley, Publisher.

Rebelo, Shea 2009: New Device Monitors Hand-Hygiene Compliance by Healthcare Workers, http://www.medscape..com/viewarticle/589931, Presented Mar. 20, 2009.

Swoboda et al, Electronic monitoring and voice prompts improve hand hygiene and decrease nosocomial infections . . . , Crit Care Med, 2004, pp. 358-363, vol. 32.

Swoboda et al, Isolation status and voice prompts improve hand hygiene, AJIC, Sep. 2007, pp. 470-476, vol. 35(7).

Ultra Clenz, Pro-Giene System—Real Time Hand Wash Monitor.

Venkatesh et al, Use of electronic alerts to enhance hand hygiene compliance and decrease transmission . . . ,AJIC, Apr. 2008, pp. 199-205, vol. 36(3).

Versus Technology, http://www.versustech.com/technology.html, Traverse City, Michigan.

Xhale Innovations Inc., Hygreen: The Intelligent Hand Hygiene System, 2009, www.xhale.com/hygreen/index.asp, Xhale Innovations Inc., Florida, USA.

* cited by examiner

HAND HYGIENE COMPLIANCE

REFERENCE TO COPENDING APPLICATION

The present application is a U.S. nationalization under 35 U.S.C. 371 of International Application No. PCT/CA2014/000615, filed Aug. 12, 2014, which is related to and claims the benefit of priority to U.S. Provisional Patent Application No. 61/865,004, filed Aug. 12, 2013, entitled "HAND HYGIENE COMPLIANCE SYSTEM, BEACON AND KIT." The disclosures set forth in the referenced applications are incorporated herein by reference in their entireties.

FIELD OF THE DISCLOSURE

The present disclosure relates to hand hygiene compliance, and in particular, to a hand hygiene compliance system, beacon, wearable monitor and kit.

BACKGROUND

Approximately one in ten people admitted to hospitals in the United States acquires a new infection during their stay. These nosocomial infections result in an estimated 100,000 deaths per year in the United States. Nosocomial infections increase the length of patient stays in hospital, contributing to increased healthcare staffing levels, increased costs and increased use of resources. This situation contributes significantly to the overall stress on the healthcare systems and increases wait times. It is estimated that approximately half of these nosocomial infections are the result of inadequate hand hygiene (HH) compliance by healthcare staff.

There is considerable evidence that hand hygiene compliance is a primary means to reduce nosocomial infections and the transmission of pathogens. Pathogens are normally present on the skin of healthcare workers and patients and on surfaces surrounding the patient. These organisms can be transferred to healthcare workers' hands where they can survive for periods ranging from minutes to hours. The final step in the transmission process is the transfer of organisms front the contaminated hands of the caregiver to other patients or clean environmental surfaces. Alcohol-based hand rubs seem to be significantly more effective than washing with soap and water in the reduction of transmission of pathogens for most pathogens. However, washing with soap and water is still sometimes a better alternative when the hands are soiled and with certain pathogens.

Unfortunately, published studies have generally found that compliance with hand hygiene requirements by healthcare workers averages about 40%. Various traditional educational and management interventions can increase awareness and improve this in the short term but generally do not provide sustainable improvements.

While some systems have been proposed to track and encourage hand hygiene compliance with prescribed protocols, commercially viable options remain costly not only in the acquisition of required system hardware, but also in the installation, maintenance and operation of the system once installed.

This background information is provided to reveal information believed by the applicant to be of possible relevance to the invention. No admission is necessarily intended, nor should be construed, that any of the preceding information constitutes prior art against the invention.

SUMMARY

The following presents a simplified summary of the general inventive concept(s) described herein to provide a basic understanding of some aspects of the invention. This summary is not an extensive overview of the invention. It is not intended to restrict key or critical elements of the invention or to delineate the scope of the invention beyond that which is explicitly or implicitly described by the following description and claims.

There is a need for a new hand hygiene compliance system, beacon, wearable monitor and kit that overcome some of the drawbacks of known techniques, or at least, that provide the public with a useful alternative. Some aspects of this disclosure provide such a hand hygiene compliance system, beacon, wearable monitor and kit.

In accordance with one aspect, there is provided a self-contained beacon for use in a hand hygiene compliance system to interface with a plurality of wearable monitors in the implementation of an automated hand hygiene compliance protocol, the beacon comprising: a mountable housing; an integrated power source; and a transmitter operatively coupled to said power source to be powered thereby, said transmitter comprising one or more emitters operatively disposed to emit a transmission beam shaped to bisect a designated attendant travel path and thus intercept passage of the wearable monitors upon passage along said path, said transmitter operable to transmit an encoded identifier via said one or more emitters to be received and processed by the wearable monitors upon passage along said path for implementation of the automated hand hygiene protocol.

In exemplary embodiments the one or more emitters may comprise two or more emitters divergently angled relative to one another in forming a combined transmission beam that divergently bisects said travel path. Respective transmission beams from each of said emitters may overlap such that the combined transmission beam is substantially uninterrupted at a level of the wearable hand hygiene monitors as the beam bisects the travel path. The combined transmission beam may define a fan-shaped beam. The combined transmission beam may define a curtain-like beam having a longitudinal beam width along the travel path that is narrower than a bisecting beam width across the travel path.

In exemplary embodiments, the integrated power source may comprise an accessible battery module for receiving one or more replaceable batteries. The housing may comprise a ceiling mountable base and a removable cover removable in providing access to said battery module.

Exemplary embodiments may include a motion sensor operable to detect, and activate said transmitter in response to, an incoming attendant along said path.

In exemplary embodiments, the one or more emitters may be operable to emit infra-red (IR) signals. The one or more emitters may be operable to emit pulse coded signals including the encoded identifier, which may include a group identifier, each group identifier common to a number of emitters. A first group identifier may identify monitored zone boundaries, and a second group identifier may identify non-monitored zones.

In accordance with another aspect, there is provided a hand hygiene compliance system comprising a self-contained beacon as defined herein.

Exemplary embodiments may further comprise a plurality of the beacons, wherein each is independently operable from one another and thus selectively mountable or dismountable in adaptively reconfiguring the system.

Exemplary embodiments may further comprise a wearable hand hygiene compliance monitor to be worn by an attendant in a facility, the wearable monitor including a receiver, such as an IR receiver and/or further comprise a plurality of such wearable hand hygiene compliance monitors.

Exemplary embodiments may further comprise a plurality of dispensers operatively mountable within said facility, each one of which comprising an integrated power source and a transmitter operatively coupled thereto to transmit a dispensing signal upon dispenser activation. The wearable monitors may record a hand hygiene action upon receiving the dispensing signal and accordingly update a hand hygiene status stored on the wearable monitors in accordance with an automated hand hygiene compliance protocol implemented by the wearable monitors.

In exemplary embodiments, the plurality of self-contained beacons may comprise a plurality of identical beacons each comprising two or more emitters fixedly disposed to emit identically shaped divergent combined transmission beams amenable to bisecting a range of attendant travel path widths such that any of the plurality of identical beacons can be used indiscriminately to intercept passage of the wearable hand hygiene monitors across any of the attendant travel path widths.

In exemplary embodiments, a first group identifier may identify monitored zone boundaries, and a second group identifier identifying non-monitored zones.

In exemplary embodiments, each wearable monitor may be operable to issue a prompt in real time when receiving a first group identifier indicating crossing a monitored zone boundary without receiving a dispensing signal within a set period of time. The prompt may in some cases be selectable and include vibration and/or sound.

In exemplary embodiments, each wearable monitor may be operable to disable the prompt either after receiving a dispensing signal or after a set period of time, whichever is sooner. The wearable monitors may be operable to provide a number of counts or values representing: A) the number of times a zone boundary is crossed without the need for a prompt, B) the number of times a zone boundary is crossed when a dispenser is activated in response to a prompt within a permitted time, and C) the number of times a dispenser is not operated in response to a prompt within the permitted time, in which case compliance ratios may be calculated as expressions of (A+B)/(A+B+C).

In exemplary embodiments, each wearable monitor may further comprise a status indicator to identify a current hygiene status based on recent hand hygiene actions.

In exemplary embodiments, the dispensers may be configured to encode a dispenser identifier in the dispensing signal. The dispenser identifier may include a group or type identifier (such as alcohol or soap) and/or a unique dispenser identifier.

In accordance with another aspect, there is provided a hand hygiene compliance system comprising: a plurality of wearable hand hygiene compliance monitors to be worn by attendants in a facility, each one of which comprising a receiver; and a plurality of self-contained beacons operatively mountable within said facility, each one of which comprising an integrated power source and a transmitter operatively coupled thereto, said transmitter operatively coupled to one or more emitters disposed to emit a transmission beam shaped to bisect a designated attendant travel path and thus intercept passage of said wearable hand hygiene monitors upon passage along said path, said transmitter operable to transmit an encoded identifier via said one or more emitters to be received and processed by the wearable hand hygiene compliance monitors upon passage along said path for implementation of the hand hygiene compliance system; wherein each of said self-contained beacons is independently operable from one another and thus selectively mountable or dismountable in adaptively reconfiguring the system.

In accordance with another aspect, there is provided a hand hygiene compliance system comprising a plurality of wearable hand hygiene compliance monitors to be worn by attendants in a facility, each one of which having a receiver; and a plurality of dispensers operatively mountable within said facility, each one of which comprising an integrated power source and a transmitter operatively coupled thereto to transmit a dispensing signal upon dispenser activation; wherein each wearable monitor records a hand hygiene action upon receiving said dispensing signal and accordingly update a hand hygiene status stored on said monitor in accordance with an automated hand hygiene compliance protocol implemented by said monitor.

In accordance with another aspect, there is provided a wearable hand hygiene compliance monitor to be worn by an attendant in a facility comprising a receiver for receiving dispensing signals from dispensers and/or zone signals from zone beacons stationed in the facility, and a controller configured for issuing hand hygiene prompting signals, and updating a hand hygiene status, upon receiving dispensing signals and/or zone signals, in accordance with an automated hand hygiene compliance protocol.

In exemplary embodiments, the controller may be configured to record a time of receiving the dispensing and/or zone signals. The controller may be configured to update the hand hygiene status with dispenser and/or zone beacon identifiers from the dispensing and/or zone signals. The controller may configured to transfer to a recording station, data including reports tracking individual hand hygiene over a selected period of time.

In exemplary embodiments, the controller may be configured to update the hand hygiene status with a dispenser type identifier from the dispensing signals, signifying different types of dispensers. The controller may be configured to update the hand hygiene status with a zone group identifier from the zone signal, signifying a first group of zone beacons at a monitored zone boundary and a second group of zone beacons in a non-monitored zone.

Exemplary embodiments may further comprise a status indicator operable by the controller to identify a current hygiene status based on recent performed hand hygiene actions. The controller may be configured to enable a prompting signal when the controller receives a zone signal without receiving a dispensing signal within a set period of time. The controller may be configured to disable the prompting signal when the controller receives a dispensing signal or after a set period of time, whichever is the sooner. The controller configured to enable the status indicator for a set period of time following a received dispensing signal. The controller configured to disable the prompting signal when receiving a zone signal while the status indicator is enabled.

In accordance with another aspect, there is provided a hand hygiene compliance system comprising a wearable hand hygiene compliance monitor as defined herein.

Exemplary embodiments may further comprise a plurality of wearable monitors.

Exemplary embodiments may further comprise a plurality of dispensers operatively mountable within said facility, each one of which comprising an integrated power source and a transmitter operatively coupled thereto to transmit a dispensing signal upon dispenser activation.

In exemplary embodiments, each wearable monitor may record a hand hygiene action upon receiving the dispensing signal and accordingly update a hand hygiene status stored on the wearable monitor in accordance with an automated hand hygiene compliance protocol implemented by the wearable monitor.

Exemplary embodiments may further comprise a plurality of self-contained beacons operatively mountable within said facility, each one of which may comprise an integrated power source and a transmitter operatively coupled thereto, said transmitter operatively coupled to one or more emitters disposed to emit a transmission beam shaped to bisect a designated attendant travel path and thus intercept passage of the wearable monitors upon passage along the path, the transmitter operable to transmit an encoded identifier via the one or more emitters to be received and processed by the wearable monitors upon passage along the path for implementation of the hand hygiene compliance system.

In accordance with another aspect, there is provided a method encoded on a computer readable medium including steps to be carried out by one or more processors on a wearable hand hygiene compliance monitor to be worn by an attendant in a facility, the method comprising receiving zone signals from one or more zone beacons stationed in the facility, issuing hand hygiene prompting signals in response to selected ones of the zone signals, receiving dispensing signals from one or more dispensers local to the wearable monitor, updating a hand hygiene status in response to the received zone signals, the received hand hygiene prompting signals and the received dispensing signals, in accordance with an automated hand hygiene compliance protocol, and transferring data according to the hand hygiene status to a recording station.

Exemplary embodiments may further comprise updating the hand hygiene status with one or more of a time of receiving one or more of the zone signals, prompting signals, and dispensing signals; a dispenser type identifier from each dispensing signal; a zone group identifier from each zone signal; and/or with a location identifier from each zone signal.

Exemplary embodiments may further comprise one or more of enabling a status indicator for a set period of time after receiving dispensing signal; issuing a prompting signal after receiving a signal from a zone boundary; and/or disabling the prompting signal after receiving a dispensing signal or after a set period of time.

Exemplary embodiments may further comprise updating the hand hygiene status with changes between states defined by the received zone signal, the prompting signal and the status indicator:

a) monitored zone boundary signal received, prompting signal enabled, status indicator disabled;
b) monitored zone boundary signal received, prompting signal disabled, status indicator enabled;
c) monitored zone boundary signal received, prompting signal disabled, status indicator disabled;
d) non-monitored zone signal received, prompting signal enabled, status indicator disabled;
e) non-monitored zone signal received, prompting signal disabled, status indicator enabled; and
f) non-monitored zone signal received, prompting signal disabled, status indicator disabled.

Exemplary embodiments may further comprise updating the hygiene status to record a change according to any one of a) transfer between a monitored zone and a non-monitored zone;
b) transfer of the hand hygiene indicator between enabled and disabled; and
c) transfer of the prompting signal between enabled and disabled.

In accordance with another aspect, there is provided a hand hygiene compliance kit comprising at least one self-contained beacon as defined herein and at least one wearable band hygiene compliance monitor as defined herein.

Exemplary embodiments may comprise a plurality of the beacons, and/or a plurality of wearable monitors.

In accordance with another aspect, there is provided a hand hygiene compliance kit comprising at least one wearable hand hygiene compliance monitor as defined herein and at least one operatively mountable dispenser, comprising an integrated power source and a transmitter operatively coupled thereto to transmit a dispensing signal upon dispenser activation.

Exemplary embodiments may comprise a plurality of the dispensers.

In exemplary embodiments, each wearable monitor may be configured to record a hand hygiene action upon receiving the dispensing signal and accordingly update a hand hygiene status stored on the monitor in accordance with an automated hand hygiene compliance protocol implemented by the monitor.

In accordance with another aspect, there is provided a hand hygiene compliance kit comprising: a plurality of wearable hand hygiene compliance monitors to be worn by attendants in a facility, each of said monitors comprising a receiver and a controller configurable to implement an automated hand hygiene compliance protocol based on signals received via said receiver; and a plurality of identical beacons operatively mountable within said facility to monitor respective attendant travel paths having different path widths, each of said beacons comprising an integrated power source and a transmitter operatively coupled thereto, said transmitter operatively coupled to two or more emitters fixedly disposed to emit identically shaped combined transmission beams amenable to bisecting a range of said different path widths such that any of said plurality of identical beacons can be used indiscriminately to intercept passage of said wearable hand hygiene monitors across any of said designated attendant travel paths within said range, said transmitter configurable to transmit an encoded identifier via said emitters to be received and processed by said controller of said wearable hand hygiene compliance monitors upon passage along said paths for implementation of the automated hand hygiene compliance protocol.

Other aims, objects, advantages and features of the invention will become more apparent upon reading of the following non-restrictive description of specific embodiments thereof, given by way of example only with reference to the accompanying drawings.

BRIEF DESCRIPTION OF THE FIGURES

Several embodiments of the present disclosure will be provided, by way of examples only, with reference to the appended drawings, wherein.

DETAILED DESCRIPTION

With reference to the disclosure herein and the appended figures, a hand hygiene compliance system, beacon, wearable monitor and kit will now be described in accordance with different embodiments of the invention.

Figure 1A:
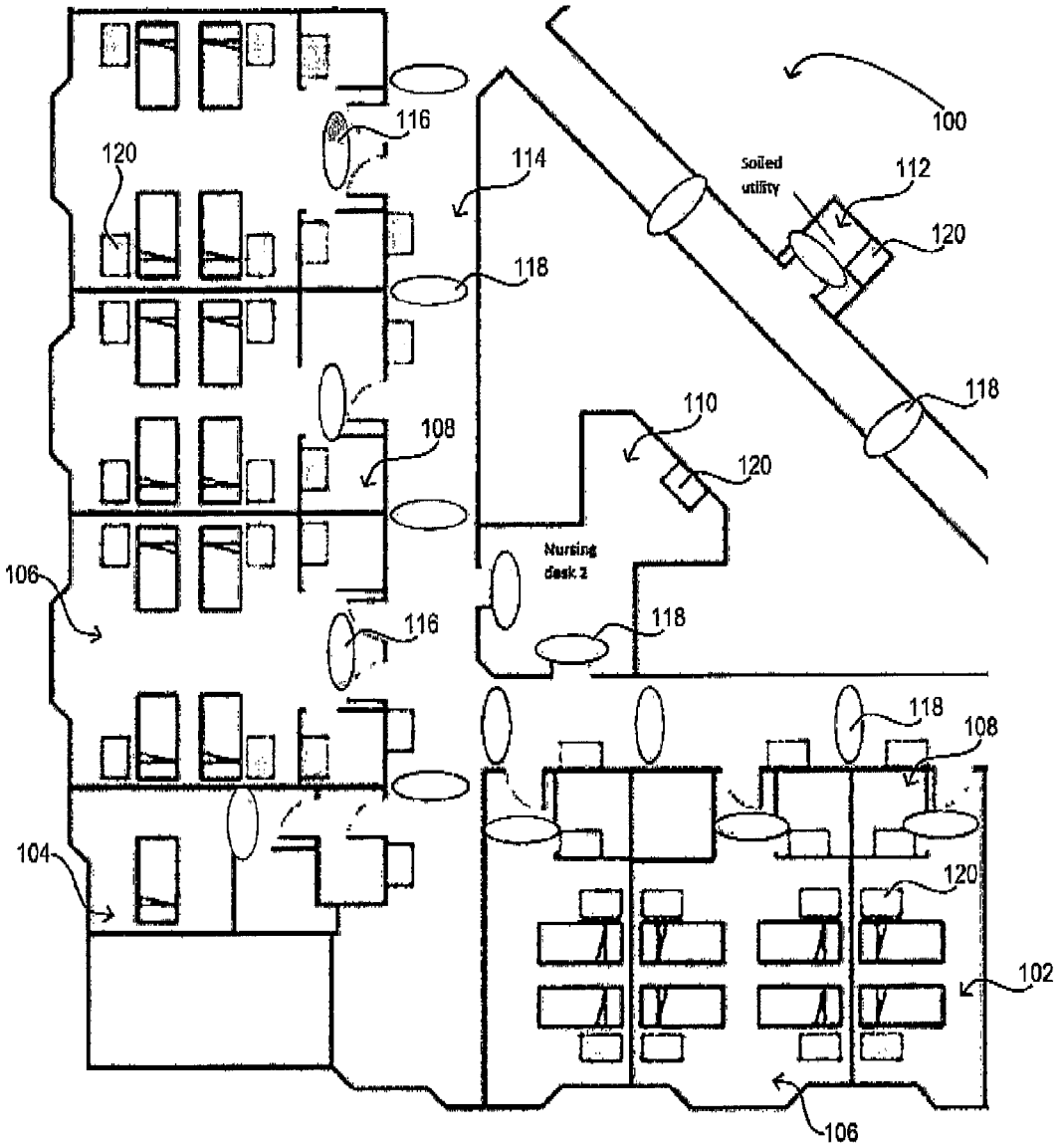
FIGS. 1A and 1B are schematic diagrams of a hand hygiene compliance system installed to operate in a medical establishment, in accordance with respective embodiments of the invention.
Figure 1B:
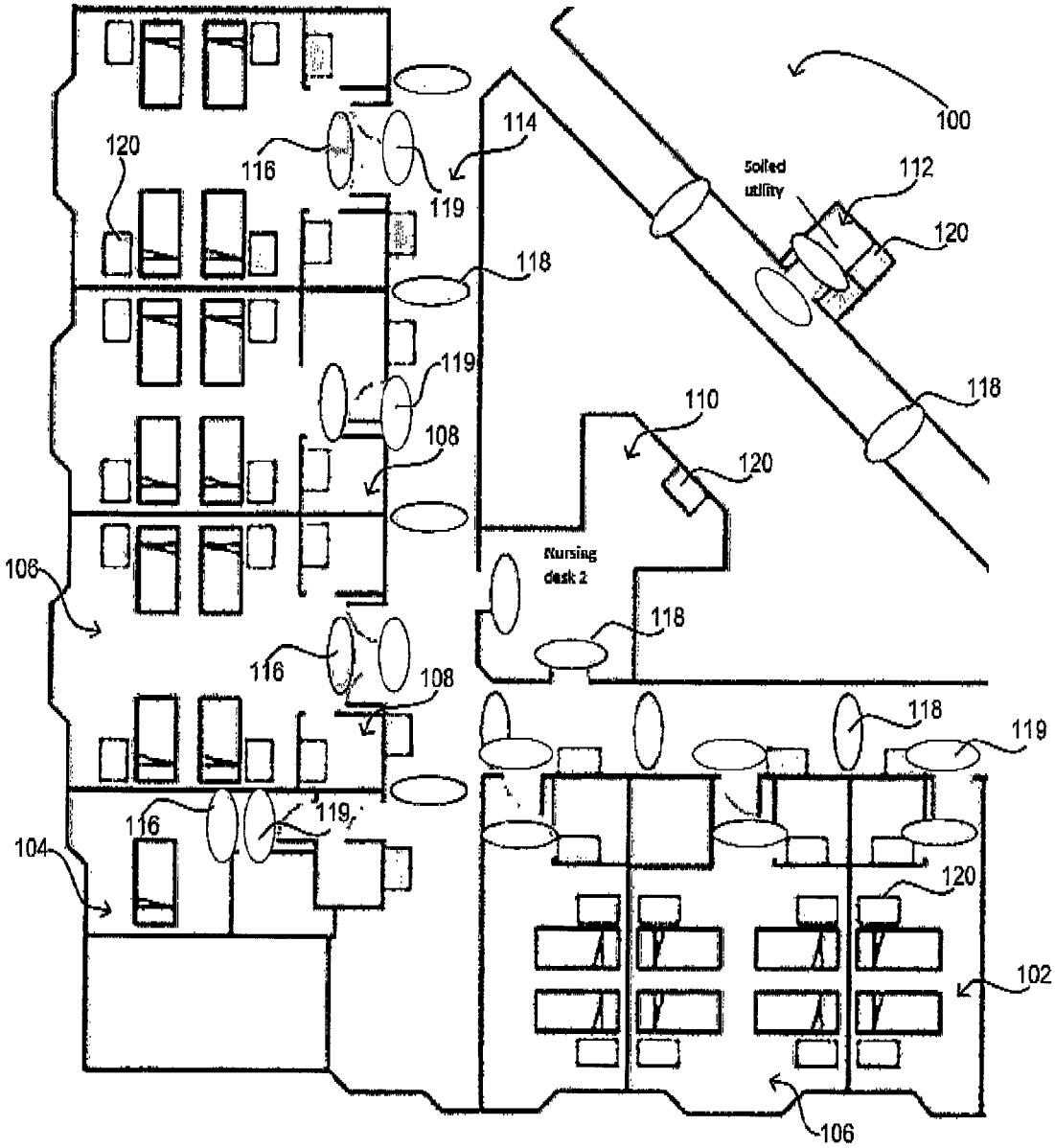

With reference to FIGS. 1A and 1B, and in accordance with respective embodiments, a hand hygiene compliance system 100 will now be described. The system 100 is generally configured for implementation in a health care facility having different identifiable zones or zone types, such as shared, isolation and ward patient rooms 102, 104 and 106, respectively, washrooms 108, nursing stations 110, soiled linens processing rooms 112, and a network of hallways 114 linking these rooms, to name a few. In order to promote adherence to preset hand hygiene protocols, the system 100 may be implemented to monitor attendant activity while operating within the facility, or at least within areas of the facility equipped with the system's monitoring components, which protocols may be sensitive to particular attendant activity, different zones and/or zone types attended by the attendant, infection risk levels associated with these zones and/or a general area, and the like.

For instance, and as will be described in greater detail below, the system is generally comprised of two or three groups (depending on the complexity of the selected system) of independently working components which, in one embodiment, are not connected by any wired or wireless network. These groups include: zone beacons 116, 118 each having a controller and one or more infrared (IR) emitters for emitting zone identifying data and thereby marking respective locations throughout the facility; instrumented stationary and/or wearable hand hygiene dispensers 120 having a controller and emitter for emitting hand hygiene activity data (e.g. soap, foam or disinfectant gel dispensing event), and wearable electronic monitors (not shown) configured to receive and process zone beacon and dispenser signals to promote and/or monitor compliance with zone-dependent hand hygiene protocols.

Different zone-based hand hygiene compliance systems and protocols are described in Applicant's U.S. Pat. Nos. 7,898,407 and 8,237,558, the entire contents of which are hereby incorporated herein by reference. In those examples, monitored zones are illuminated by respective sets of beacons whose combined illumination coverage more or less illuminates an overall area of the zone to ensure HH monitors worn by attendants in those zones receive zone beacon data necessary in the implementation of HH compliance protocols. In the Example of FIGS. 1A and 1B, however, beacons 116 are disposed so to rather monitor the entry of a given attendant within a monitored zone (e.g. zones where HH protocol compliance is of designated importance, for example patient rooms, soiled materials processing rooms, etc.), whereas beacons 118 are disposed so to monitor passage of the given attendant in a non-monitored zone (e.g. hallways, nursing station) and thus optionally confirm exit of this given attendant from a previously recorded monitored zone entry and/or routinely track attendant locations even when not entering monitored areas. In the example of FIG. 1B, zone exit beacons 119 are further or alternatively paired with zone entry beacons 116 to distinctly monitor entries and exits by attendants, namely by monitoring an order in which entry and exit beacons are detected during travel. To do so with a certain level of accuracy, entry and exit beacon illumination footprints had to be drastically reduced, effectively reducing illumination to a curtain-like illumination pattern shaped to bisect a designated attendant travel path (e.g. doorway) and thus intercept passage of the wearable monitor. The implementation of this alternative configuration further enables for greater system granularity in facilitating the definition of multiple zone types and effectively monitoring entries and exits for each type. This reduced footprint also facilitates definition of multiple zones within a same room, such as within a multi-patient room where physical zone delimitations are of limited breadth.

Unlike other hand hygiene monitoring technologies, the system 100 is a deeply embedded solution, with the wearable monitors being responsible for overall logic of operation without relying on a central control or data processing unit. This approach makes it possible to implement a real-time hand hygiene reminding functionality, as independently operating wearable monitors not only record the time of entering/leaving monitored areas and dispenser activations, but perform real-time matching of hand hygiene opportunities and hand hygiene actions, with timing characteristics being independent of the overall scale of the system and the number of devices used. After data is downloaded, a central system software component can be used mostly for generating reports, statistical analysis as well as for changing configuration settings of the devices.

The versatility of the herein-described system is further enhanced by the simplicity of installation and operation of the zone beacons 116, 118, 119, which affords greater system scalability and customizability. For instance, and as will be described in greater detail below, the system may be provided as a kit for installation in accordance with particular application specifics and requirements. In one example, a given number of zone beacons, dispensers and wearable monitors may be deployed for a given facility to implement a particular hand hygiene compliance program, whereby the number of monitored zones, dispensers and wearable badges may be selected based on a number of parameters including, but not limited to, an implementation budget or resources, zones or areas deemed to be of critical or higher importance, a phase-in implementation sequence (e.g. gradual phase-in process over a number of years), and/or selection of particular functions and attributes needed or desired in different areas and/or over multiple implementation phases.

For example, in one embodiment, the system may first be installed for the purpose of monitoring attendant hand hygiene event frequency. In such a simplified version of the system, identical instrumented dispensers are provided across a given facility or area, and wearable monitors are distributed amongst attendants working in this area so to monitor each time each given attendant activates one of the instrumented dispensers. The monitor may also include a HH indicator preprogrammed to display a HH status (e.g. green light) upon the attendant activating a monitored dispenser in compliance with a preset frequency (e.g. within a designated time period from a previous dispenser activation). In a similar embodiment, each dispenser may further be configured to communicate a dispenser identifier, which may include a group identifier or type identifier, such as soap or alcohol or other type dispensers, or a unique dispenser identifier, for example including a specific dispenser identifier, so as to not only track HH events, but also a type of event or a dispenser location (when the dispenser identifier also includes a location identifier). The system may be later upgraded to incorporate installation of zone beacons to track HH opportunities, i.e. implement zone-dependent HH compliance protocols, and record attendant compliance with such protocols.

Alternatively, the system may be first configured to track HH opportunities via a set of installed zone beacons, and promote timely HH reminders to attendants via a set of wearable monitors, and be later upgraded to include installation of instrumented dispensers to track (and display) attendant HH compliance, for example. In each of the above examples, a wireless network may be operated in conjunction with the HH compliance system to allow real-time or near real-time reporting to a central processing station.

While the above provides for different "phase-in" implementation sequences, the various components of the herein described embodiments further allows for significant versatility in system implementation across different sections or areas within a given facility. For example, since the system's logic is predominantly implemented through the wearable monitor, different areas and/or sections within a same facility may be serviced by a same wearable attendant monitor and track compliance with different levels of HH requirements. For example, a highly monitored area (e.g. Intensive Care Unit in a hospital) where HH compliance is critical may be heavily promoted through active zone and dispenser activation monitoring, with real-time attendant HH compliance reminder settings and indicators, whereas a lower risk area (e.g. cafeteria, staff room, etc.) may be devoid of zone beacons and rather only monitor HH frequency for consideration upon later reentering a high risk zone. In this context, the wearable monitor will simply identify that the attendant has left a last attended high risk zone, thereby disabling high risk HH compliance protocols, and later track reentry to that high risk zone and thereby reinitiate those protocols. Accordingly, where a given facility is progressively phasing-in the system, wearable monitors may be indiscriminately distributed to all facility attendants, while different levels of HH compliance monitoring may be automatically implemented for different areas depending on the level of system implementation in those areas. In this scenario, upon installing new zone beacons, for example, in an area previously devoid of such beacons, overall system reconfiguration will not be required. Rather, wearable monitors will simply detect new zone identifying data upon entering the upgraded zones and implement standard HH compliance protocols accordingly.

As will be described in greater detail below, the implementation of the above-described HH compliance systems, and particularly the system shown in FIG. 1B, is further greatly facilitated by the provision self-contained beacons that can be used indiscriminately from zone to zone to bisect attendant travel paths of different widths or shapes. Namely, unlike prior systems where specific beacon group configurations and spatial distributions had to be customized for each zone, a set of identical beacons, as described herein, can be used in the present system throughout the facility irrespective of location. For example, a same beacon model can be used to bisect doorways, hallways and/or intra room pathways (e.g. between patient beds, etc.) irrespective of the effective width of the designated pathway. The compact beacon design further described below also avoids encountering physical constraints in the installation of these beacons, particularly when monitoring narrow pathways such as doorways or the like, but also in mounting these beacons in already crowded spaces (e.g. amongst facility lighting, communication, and signaling components, to name a few). Clearly, as will be appreciated by the skilled artisan, multiple beacons may nonetheless be used in combination for particularly wide pathways without limiting the general convenience provided by the use of beacons, such as described herein, amenable to bisecting pathways of different widths.

Figure 2A:
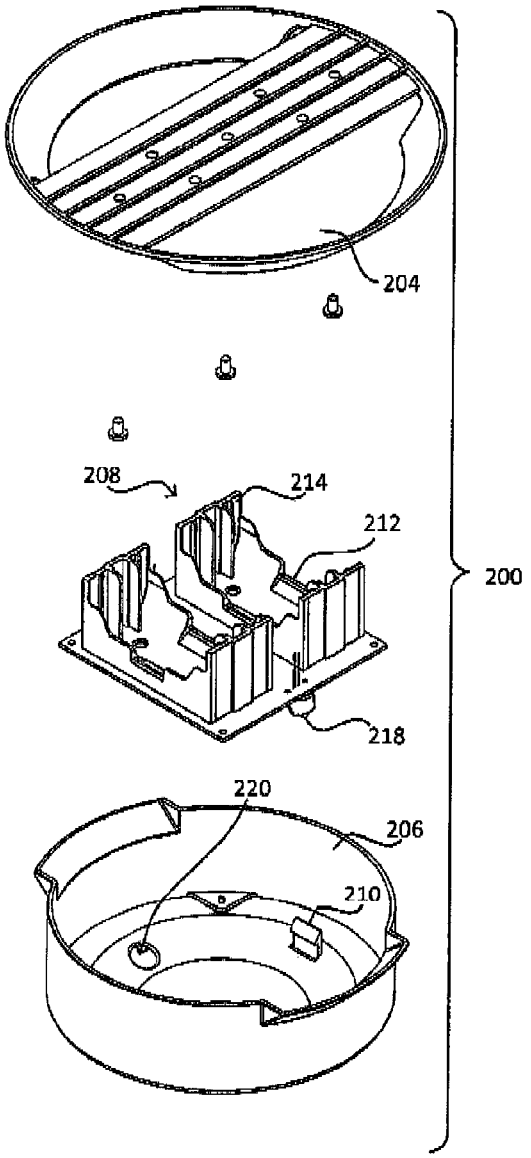
FIGS. 2A and 2B are bottom and top exploded perspective views of a beacon for use in a hand hygiene compliance system, such as that shown in FIGS. 1A and 1B, in accordance with one embodiment of the invention.
Figure 2B:
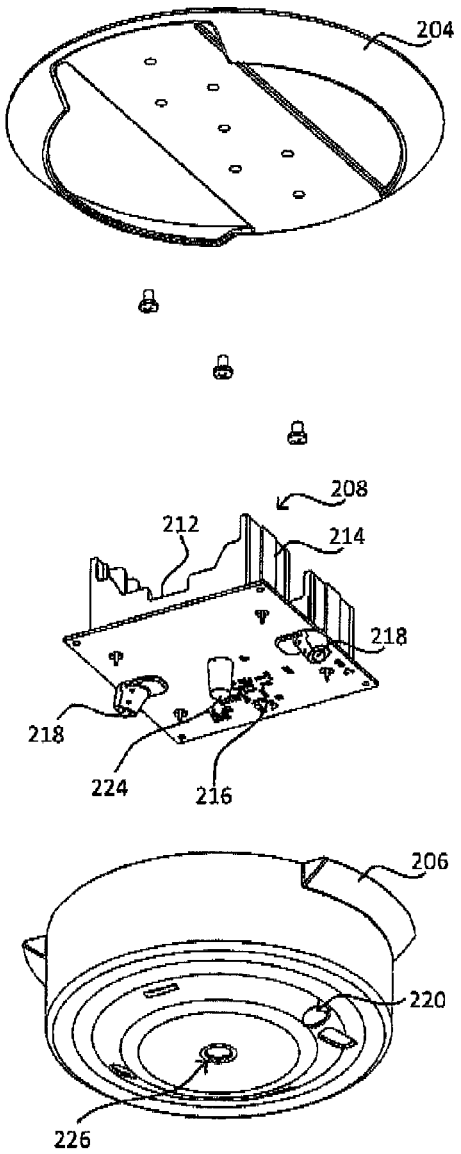

With reference now to FIGS. 2A and 2B, an illustrative zone beacon, generally referred to using the numeral 200, will be described now in accordance with one embodiment of the invention. In this embodiment, the beacon 200 consists of a self-contained beacon for use in a hand hygiene compliance system to interface with a plurality of wearable hand hygiene compliance receivers, for example as introduced above. The beacon 200 generally comprises a mountable housing, having in this example a surface-mountable base portion 204 and a removable cover 206, and a self-powered transmission module 208 operatively mounted therein.

In this particular example, beacon 200 is readily mountable to a support structure or surface (e.g. ceiling) by first fastening the base portion 204 to the support, fitting the transmission module 208 therein, and snap-fitting the cover 206 to the control module 208 via cooperating cover snap-fitting hooks 210 and structural control module grooves 212. The simple installation of beacon 200 allows for a relatively straightforward deployment of the system by reducing beacon installation costs and time. Further, given the self-powered nature of the beacon, hardwiring of the beacons 200 is not required, resulting in greater installation versatility and flexibility. Also, as described above, the compact nature of the beacon design is amenable to installation in different configurations, namely without physical interference from surrounding materials, structures and components, without limiting its ability to provide intersecting transmission beams (discussed in greater details below) for different attendant pathway types and sizes (e.g. doorways, hallways, intra-room pathways, etc.).

In this example, the transmission module 208 comprises an integrated power source, such as integrated battery receiver 214 readily accessible to replace batteries (in this example consisting of two standard low-self-discharge NiMH batteries which are easy to replace and have an estimated battery life of approximately 6 months) during routine maintenance. The transmission module 208 further comprises a transmitter and related control circuitry (e.g.

circuit board or controller 216) operatively coupled to the power source 214 to be powered thereby, and comprising one or more emitters, such as IR emitters 218, operatively disposed to emit a transmission beam through corresponding apertures 220 formed in the cover 206.

A motion sensor 224 is also provided in this example to project through corresponding cover aperture 226 to detect approaching attendants and activate the beacon transmitter accordingly. As will be appreciated by the skilled artisan, the optional motion sensor may be used to promote energy conservation practices, namely to avoid continuous beacon emissions and rather only operate beacon emissions in the expected presence of an attendant.

In this example, the beacon emitters 218 are disposed so to produce a beacon transmission beam shaped to bisect a designated attendant travel path and thus intercept passage of the wearable hand hygiene IR receivers upon passage along this path. As introduced above, the emitted beam is generally set to transmit an encoded identifier (e.g. encompassing zone data such as zone ID, type, infection risk level, HH compliance level, etc.) to be received and processed by the wearable hand hygiene compliance IR receivers upon passage along this path for implementation of an automated hand hygiene compliance protocol. In this example, two emitters 218 are divergently angled relative to one another in forming a combined transmission beam that divergently bisects the travel path, wherein an overlap between respective beams results in a substantially uninterrupted beam "curtain" at a level (i.e. height) of the wearable hand hygiene IR receivers as they travel along the bisected path.

In accordance with different embodiments, emitters may be fixed at different angles relative to one another, or again comprise different emitter beam width characteristics (e.g. narrow vs. broad beam angle) to accommodate different path widths. Irrespective, it will be appreciated that a set of identical beacons can be used to bisect attendant pathways of different widths without unduly limiting the efficiency and effectiveness thereof.

Figure 3:
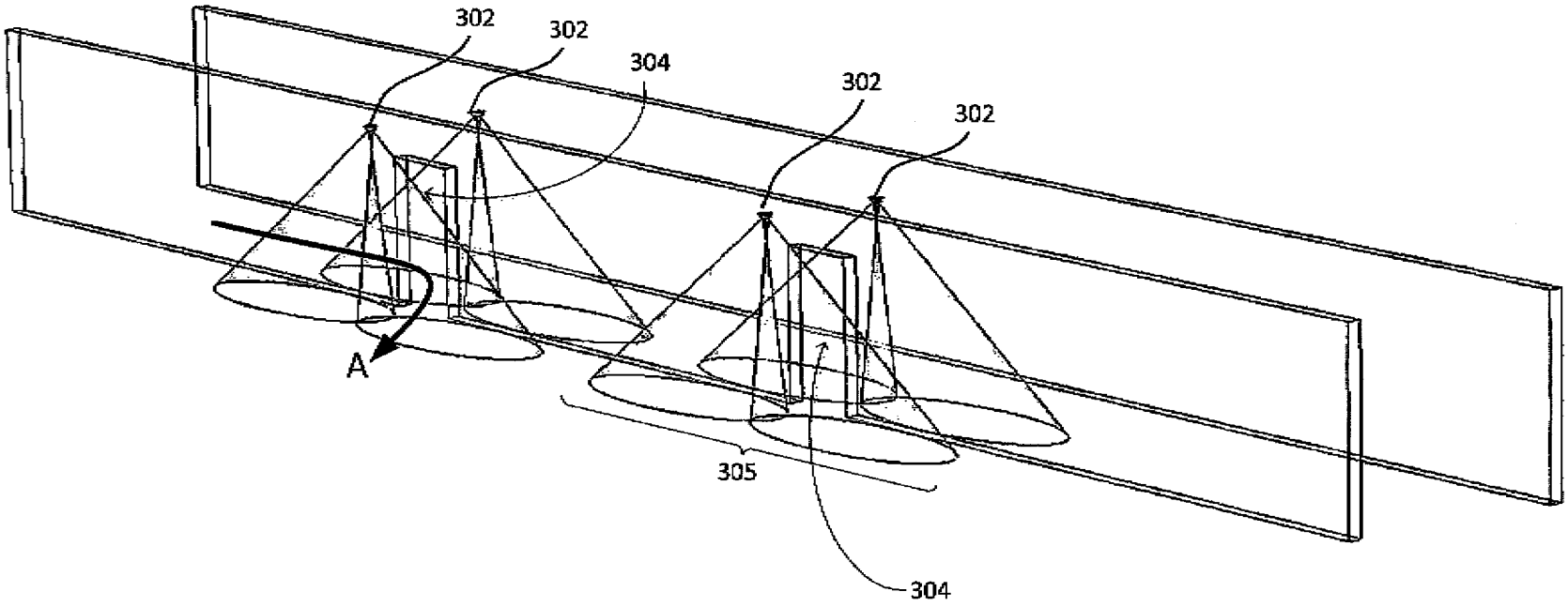
FIG. 3 is a schematic perspective view of two pairs of beacons, such as that shown in FIGS. 2A and 2B, operatively mounted on either side of respective doorways in monitoring attendant entries and exits through these doorways as part of a hand hygiene compliance system such as that shown in FIG. 1B, in accordance with one embodiment of the invention.
Figure 4A:
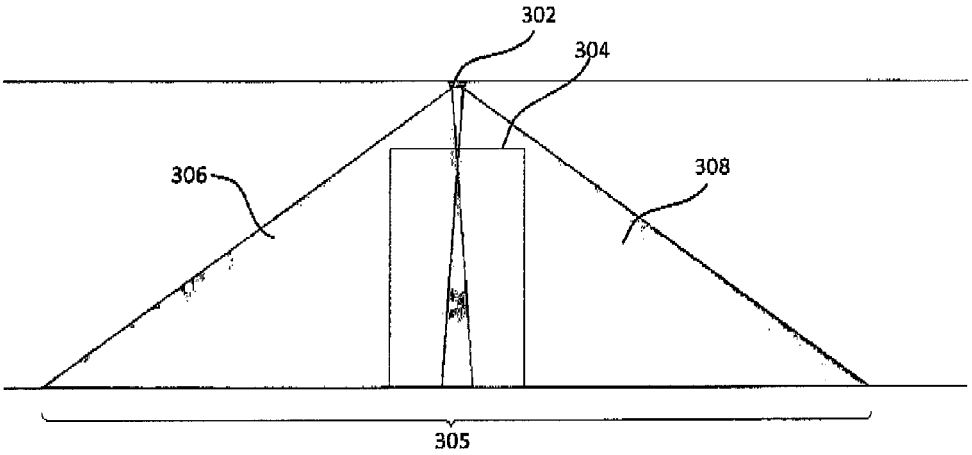
FIGS. 4A and 4B are front and top views, respectively, of a combined emission beam shape transmitted from a given pair of beacons operatively mounted on either side of a given doorway, as shown in FIG. 3, in accordance with one embodiment of the invention.

FIG. 3 provides an example of respective paired beacons 302 installed to monitor travel and direction through either of adjacent doorways 304. In this example, each of the paired beacons 302 comprises a respective pair of divergently illuminating emitters not explicitly shown) forming a combined illumination beam 305 that bisects passage (arrow A) through its corresponding doorway 304. As best shown in FIG. 4A, illumination beam 306 is formed at an angle relative to the vertical, and oriented so to overlap an adjacent and oppositely angled beam 308 to form a combined curtain-shaped beam 305 effectively bisecting passage through the monitored doorway 304. In this illustrative embodiment, the combined beam 305 is fan-shaped, though other combined beam shapes may also be considered without departing from the general scope of the present disclosure.

Figure 4B:
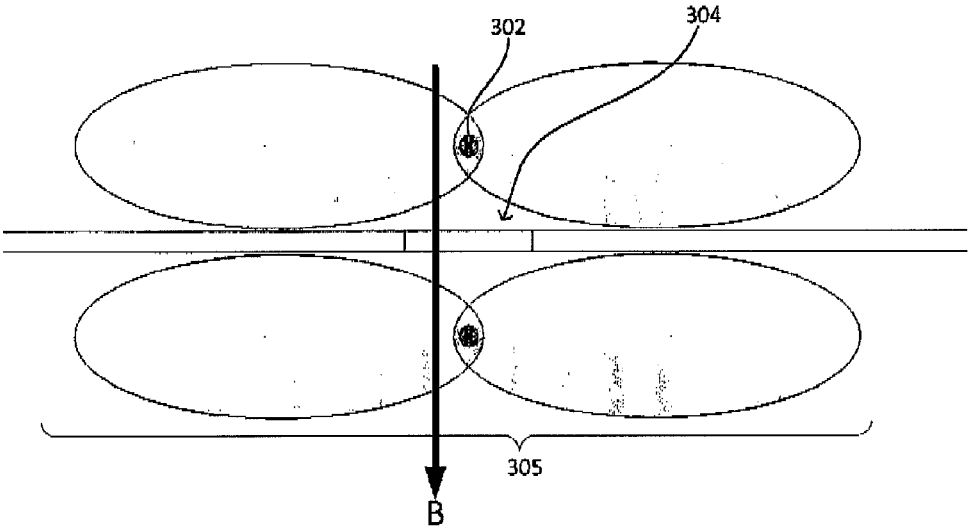

As best seen in FIG. 4B, the combined transmission beam 305 defines a curtain-like beam having a longitudinal beam width along the travel path B that is narrower than a bisecting beam width across the travel path. Namely, the beacon footprint is such that adjacently disposed beacons 302 may be paired to generate parallel curtain-like beacon transmission patterns to monitor attendant entry into, and exit from a given zone via a designated pathway (i.e. doorway).

Figure 5:
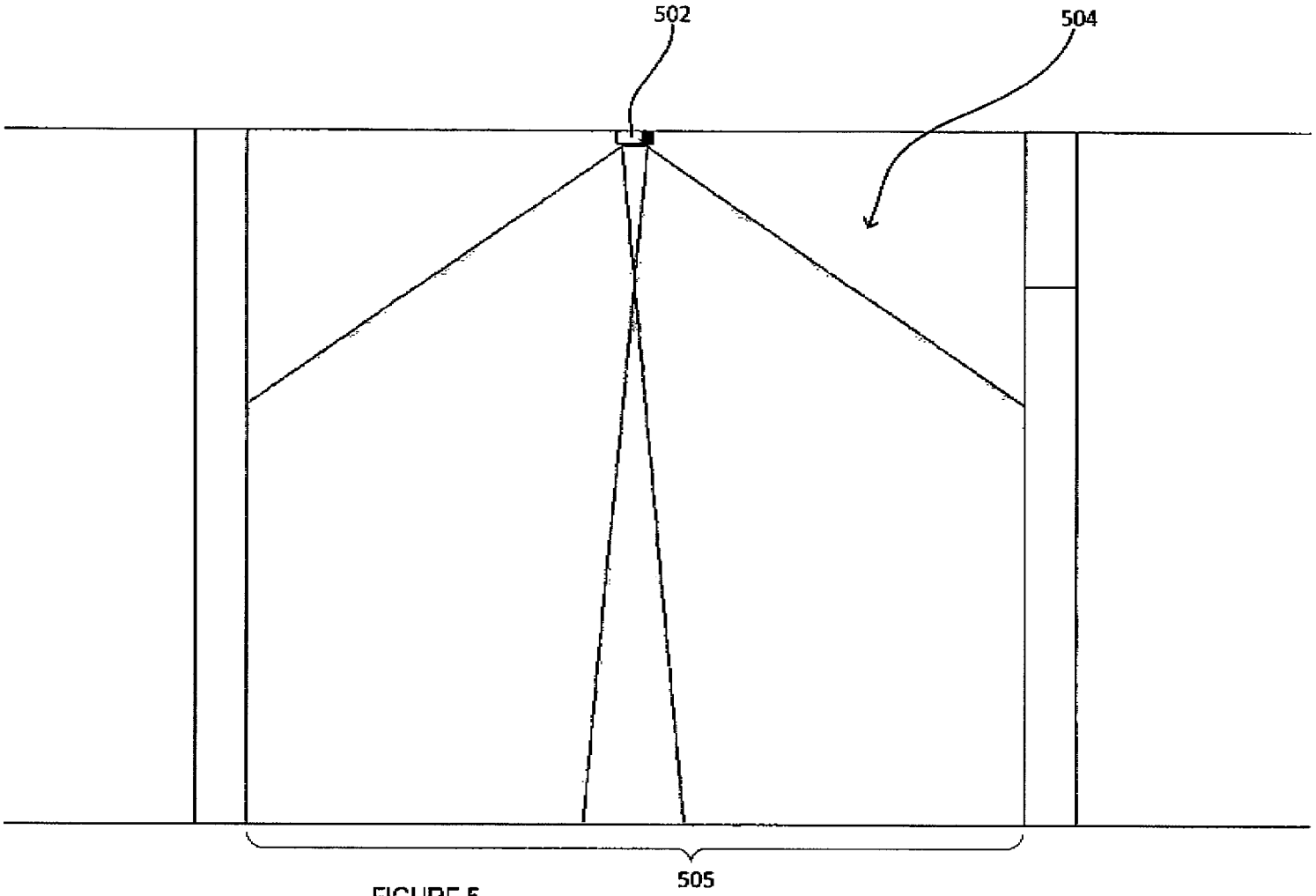
FIG. 5 is a front view of a combined emission beam shape transmitted from a beacon, such as shown in FIG. 3, operatively mounted in a hallway in monitoring attendant passage through this hallway, in accordance with one embodiment of the invention.

FIG. 5 provides a similar example whereby a single "fan-tail" beacon 502 is provided to bisect a hallway 504, producing a combined emission beam 505 much like that shown in FIG. 4A. In the context of hallway monitoring, however, and as will be appreciated by the skilled artisan, attendant travel directionality may be of lesser relevance and therefore, paired beacons may not be required. Further, upon sequentially tracking attendant travel along the hallway via a set of interspaced beacons, attendant directionality may nonetheless be monitored and considered in HH compliance protocols, as appropriate or desired.

As noted above, the combination of emissions provided from two (or more) emitters (e.g. IR emitters) may provide sufficient coverage area to control a doorway and/or hallway cross section, as shown, as well as other relevant attendant pathways such as intra-room pathways, for example. In combination with a motion sensor, such as a passive infrared motion sensor, control transmissions can be limited to just a few seconds creating the "fantail" just before a caregiver approaches the area. Depending on the application at hand, the angle of IR emitters can be adjusted to change the width of combined beam, either by mechanically titling the IR emitters, or again by selecting different emitters having designed manufacture emission angles (e.g. 10 degree output beam vs. 60 degree output beam). This versatility may thus allow for very fine monitoring, for example in monitoring respective patient bed areas in multi-bed rooms, and/or broad monitoring such as in the context of a hallway of wide entryway. Adjusting the emitter intensity depending on the application at hand may further improve system reliability by promoting greater coverage efficiency (e.g. efficient power consumption vs. effective pathway coverage) and minimizing undesirable artifacts such as multiple reflections, etc.

Figure 7:
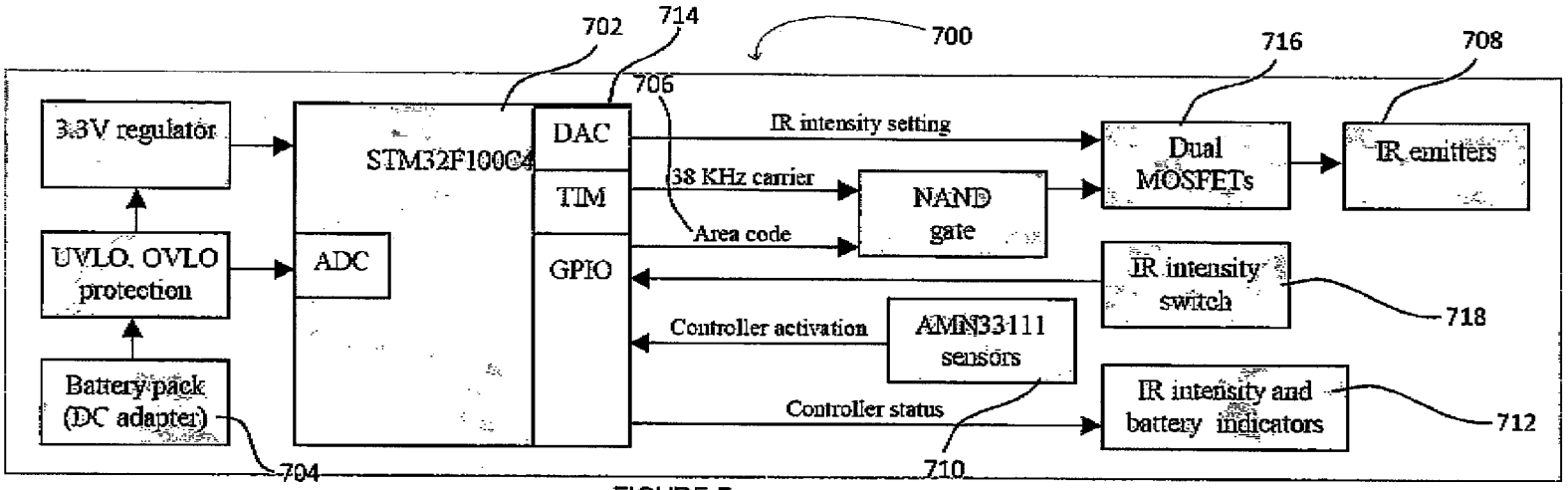
FIG. 7 is a block diagram of exemplary beacon hardware, in accordance with one embodiment of the invention.

FIG. 7 provides a block diagram of a beacon 700 depicting exemplary hardware thereof, in accordance with one embodiment of the invention. In this embodiment, a controller 702 (e.g. ARM Cortex-M based microcontrollers (MCU), such as for example an STM32F100C4T6 MCU) is powered by a rechargeable battery pack 704 (e.g. 2.4V NiMH battery pack, two D cells) to emit zone identifying data (e.g. area code 706) via one or more IR emitters 708. To reduce power consumption, the controller 702 is activated by one or more passive motion sensors 710 (e.g. AMN33111 passive infrared motion sensor) when motion in close proximity to the monitored area is detected, thus reducing power consumption. In this example, a spot type motion sensor was selected to restrict the detection range and to initiate transmission only when a caregiver is crossing the boundary of the monitored area defined by the infrared emitters 708. Typically the controller includes one or two AMN33111 sensors 710 with adjustable orientation, with the number of sensors depending on the room layout, location and size of the monitored area. For example, in one embodiment the controller 702 transmits a 38 kHz modulated code including a zone identification number and type (i.e. area code 706) for a duration of 15 seconds after activation.

A controller status indicator 712 is also provided to visually indicate a selected signal intensity level and a state of the battery pack when the controller is in an active state. For example, a low battery indicator may simplify maintenance operations as battery life may vary significantly from zone to zone depending on the patient care procedures performed in that zone, the number of patients in the zone, the size and location of the monitored zone, mobility of the patients and other factors. As noted, the intensity of infrared signal can also be selected on site (e.g. via switch 718) depending on the application and monitored zone requirements, and is defined in this example by setting the onboard DAC 714 of the controller 702 to regulate the current through one of the stages of the dual MOSFETs 716 controlling the infrared emitters 708. This function may be useful to compensate for variations in light conditions and structural characteristics of the environment, for example. The selected intensity level is stored in the flash memory of the controller 702 and is thus maintained through power-on resets.

In accordance with one embodiment, controllers for stationary dispensers (not shown) are based on the same MCU and have a similar structure as that provided for the exemplary beacon controller 702 discussed above. In one embodiment, however, these are powered by two AA alkaline batteries given reduced power and operational requirements. In one embodiment, the device makes use of a MCP1640D DC-DC converter to maximize battery life and maintain constant intensity of infrared signal independent on the state of the battery. When the controller is in power saving mode the DC-DC converter can be bypassed and the STM32F100C4T6 MCU is powered directly from the batteries with interrupt from its PVD (programmable voltage detector) peripheral used to detect and indicate low battery status.

Figure 8:
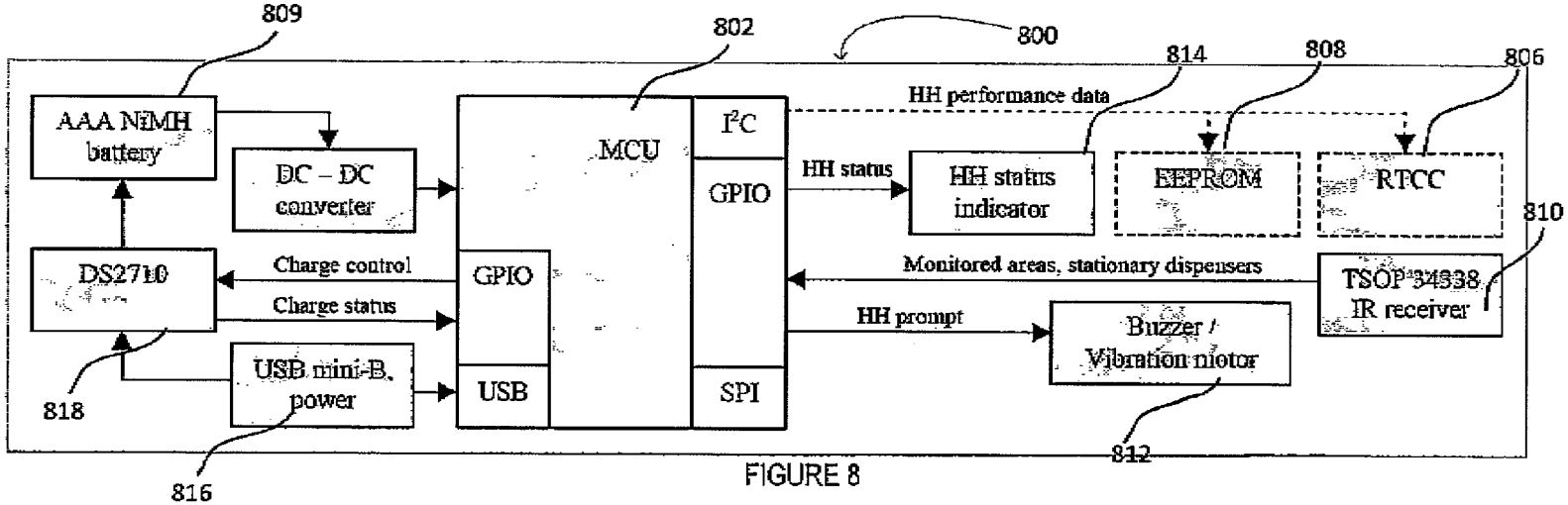
FIG. 8 is a block diagram of exemplary wearable monitor hardware, in accordance with one embodiment of the invention.

With reference now to FIG. 8, and in accordance with one embodiment, a block diagram of a wearable electronic monitor 800, and particularly hardware thereof, will now be described. In the illustrated embodiment, the monitor 800 comprises an ARM Cortex-M3 microprocessor 802. An onboard RTCC (real time clock/calendar) peripheral or external I2C RTCC 806, and flash memory or EEPROM 808 can be used for time keeping and data logging, respectively. The controller 802 is powered by a battery 809, such as single AAA NiMH battery.

While a different MCU may be selected for each component type in selecting microcontrollers with features and peripherals that may better fit the requirements of these various components, the utilization of a common platform across the whole system may improve code reuse, make technology more upgradeable, and allow the same tool chain to be used for the development of software for all the devices in the system.

In the illustrated embodiment, a high noise immunity TSOP34338 infrared receiver 810 is used to receive zone and dispenser data, and interrupt driven algorithms are implemented to implement more efficient power modes and improve reaction time of the wearable monitor.

The monitor further comprises a buzzer 812 to provide hand hygiene compliance reminders, and a visual indicator 814 to identify a current hygiene status based on recently performed hand hygiene actions.

In normal operation mode, the wearable monitor is powered by the single NiMH battery, but when connected to a PC, it can be powered from a USB port 816 so that previously recorded hand hygiene data can be downloaded or configuration settings of the device can be changed regardless of the battery state or with the battery not installed. A DS2710 single cell NiMH battery charger 818 is also provided in this example so the battery can be charged when the wearable monitor is connected to the USB port 816.

Data recorded by the wearable monitors may include, but is not limited to the exact time of entering and leaving monitored areas as well as hand hygiene actions performed. The records may include identification codes of the monitored areas and dispensers as well as additional attributes such as hand hygiene status at the moment when the area was entered or left, activation of the dispenser as a result of a hand hygiene prompting signal, and type of dispenser used. Reporting functions of the system may allow generation of individual and aggregated hand hygiene performance reports, tracking individual hand hygiene activity and hand hygiene sustainability over selected periods of time, monitoring the usage of dispensers and hand hygiene performance at specific locations, comparison of individual and aggregated results, to name a few.

Both the hand hygiene reminding signals and hand hygiene status indicator can be optionally disabled on site, so that the wearable monitors "silently" collect hand hygiene data. This operation mode is useful as a method for baseline data collection during clinical trials where the influence of various parameters on hand hygiene performance is examined.

Figure 6:
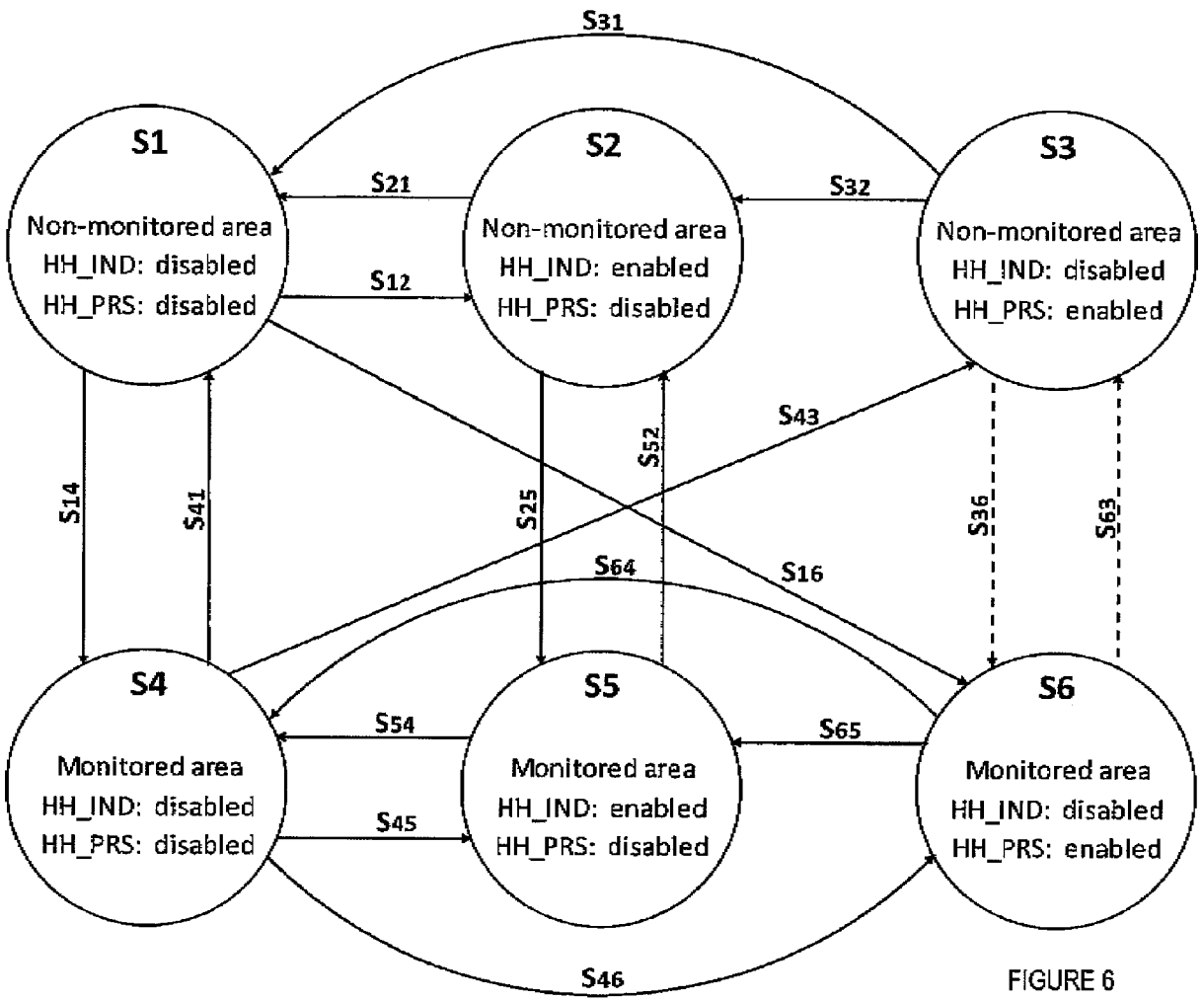
FIG. 6 is a state machine diagram for an automated hand hygiene compliance protocol implemented by a wearable monitor in system such as that shown in FIGS. 1A and 1B, in accordance with one embodiment of the invention.

FIG. 6 provides an example of state machine logic that can be implemented, in accordance with one embodiment, in the context of a hand hygiene compliance system, as described above of an application covering monitored and non-monitored zones. In this case, monitored zones are those where HH protocol compliance is of designated importance, for example patient zones including rooms, intensive care rooms and sectors, soiled materials processing rooms and the like. Active monitoring is occurring at the boundary of such monitored zones, where prompts to comply to an applicable HH protocol and monitoring compliance of an applicable HH protocol may both triggered by the crossing of the boundary, either to enter or to exit the monitored zone. Non-monitored zones are those in which an HH protocol compliance is not of designated importance. However, the non-monitored zones are nonetheless provided with beacons in order to allow for other functions, such as to confirm that an attendant has completed a compliance task when exiting the monitored zone. It may also be beneficial in some cases to allow for tracking of attendant activities in non-monitored zones, for instance to track the movement of an attendant during the course of a work shift, between monitored zones. In this example, the wearable monitor may take any one of six states, denoted S1 to S6, based on a combination of the following three binary characteristics: monitor is located in a monitored vs. non-monitored area; hand hygiene indicator (HH_IND) is enabled or disabled; and hand hygiene prompting signal (HH_PRS) is enabled or disabled. The following provides a listing of logic steps programmed into the wearable monitor's controller to update the status of the monitor, namely adjust an operational state thereof, in response to user activity while wearing the monitor, for example in travelling between recognizable zones and/or in performing routine hand hygiene actions.

Actions S11, S22 and S33 (not shown) reference the recognized passage of a monitor from a non-monitored area to another non-monitored area (e.g. walking down a hallway), in the event of which, a state of the monitor remains unchanged, but a new location of the monitor may nonetheless be tracked.

Action S12 represents that a hand hygiene action was performed, which activates the hand hygiene status indicator to switch the monitor's state to state S2.

Once a hand hygiene action expiry time for non-monitored locations elapses (e.g. time may be configured for a given clinical setting or even for individual users), as represented by action S21, the hand hygiene indicator is turned off and the monitor returned to state S1.

Action S14 represents that a beacon at a monitored area was crossed, but that hand hygiene prompting is not required when entering this particular area (for example, based on a given area type or specific area identification, such as a soiled or clean utility room); the monitor location is updated accordingly.

Upon leaving the monitored area where hand hygiene prompting was not required, for a non-monitored area, the location is again updated and the hand hygiene prompt is either enabled (action S43 to state S3—e.g. upon leaving a soiled utility room) or remains disabled (action S41 to state S1—e.g. upon leaving a clean utility room).

Where a designated prompting duration period for non-monitored locations elapses before a hand hygiene action is detected (e.g. time may be configured for a given clinical setting or even for individual users), the prompting signal is turned on to state S3. However, where a hand hygiene action is performed in response to the hand hygiene prompting signal (while prompting signal is active), the prompting signal is turned off and the status indicator is enabled (action S32 to state S2).

When a monitor travels from a non-monitored area to a monitored area where a hand hygiene action is required (e.g. as dictated by a specific zone type or zone identity—patient room, ICU, etc.) via action S16, the hand hygiene prompting signal is enabled and the location is updated. The indicator remains disabled and the prompting signal enabled until a hand hygiene action is performed (action S65 to S5).

If, on the other hand, the prompting signal is ignored and the monitor then travels to a non-monitored area (action S63 to state S3), the location is updated and the prompting signal is maintained for a designated time period (see action S31 described above). A prompting signal will also remain enabled where a monitor travels from a non-monitored area to a monitored area (action S36 to state S6). Similarly, if the prompting signal is ignored for a designated time period while within the monitored area, the hand hygiene prompting signal may be turned off (action S64 to state S4).

In the event that the monitor travels from one monitored area directly to another monitored area (e.g. in a multi-bed patient room), location information is updated and the previously disabled prompting signal is again activated (action S46 to state S6).

Where a hand hygiene action was completed just before leaving or entering a monitored area (action S52 and S25, respectively), namely where a new zone is reached before a designated time period for a previous hand hygiene action has elapsed, the indicator will remain active, and the prompting signal inactive.

Finally, where a hand hygiene action is performed while within a monitored area in the absence of a prompting signal, the indicator is enabled and prompting signal remains disabled (S45), until an expiry time for, monitored locations elapses, at which point the indicator is again disabled (S54).

Thus, in one or more exemplary embodiments, the beacon and dispenser emitters may transmit signals using infra-red (IR) coded signals. For example, the dispenser signal may originate from a dispenser activation indicator. The zones and dispenser emitters may be configured to send pulse coded identifiers, in a manner to be received and recorded by the wearable monitor. The zones may also be coded or configured to belong to a number of groups, such as two groups with a first group for monitored zone boundaries, that is zones at the boundary of monitored zones including patient areas, and a second group for non-monitored zones such as non-patient zones including hallways, other access areas, soiled linen rooms, cafeterias, and the like, which may simplify required logic in the monitors. The wearable monitors may also provide prompts in real time when staff enter or exit a patient zone without a dispenser being activated within a set period of time. The prompt may be selectable among a number of signals, including vibrations and/or sound. The prompt may then be configured to cease when a dispenser is activated or after a set period of time, whichever is the shorter. A wearable monitor may be configured to display one or more green lights for a fixed period following activation of a dispenser. Entry or exit of a patient zone during the time that the green light(s) are displayed may then be considered to be a successful event, requiring no further prompt. A system embodying wearable monitors together with dispensers and/or beacons as described herein may provide a number of counts or values which, among other possible counts or values, may include A) the number of times a zone boundary is crossed without the need for a prompt, B) the number of times a zone boundary is crossed where a dispenser is activated in response to a prompt within the permitted time, and C) the number of times that a dispenser is not operated in response to a prompt within the allowable time. This real time prompting requires no connection to a computer network and may be implemented entirely as function of logic contained within the wearable monitor. These counts may then be output separably for entry and exit events. Historical and cumulative feedback may be obtained from data stored within the wearable monitor that may be uploaded automatically when returned to a docking location for charging, transferring data or other tasks. Compliance ratios may then be expressed or calculated, for instance, as (A+B)/(A+B+C), or variations thereof, which may be independently expressed for entry to and exit from monitored zones such as patient areas and other specially monitored areas. In other words, the compliance ratios may be provided for each zone boundary. Data, such as detailed history, may be made available on the usage of the wearable monitors, dispensers and the like including the crossing of all identified zones and operating all identified alcohol, soap or other dispensers with times of occurrence of each user, and/or an aggregate of a group of users, such as a team of staff at a particular zone, unit, department or the like.

As will be appreciated by the skilled artisan, additional and/or alternative actions and state sequences may also be considered within the present context without departing from the general scope and nature of the present disclosure.

While the present disclosure describes various exemplary embodiments, the disclosure is not so limited. To the contrary, the disclosure is intended to cover various modifications and equivalent arrangements included within the general scope of the appended claims. The scope of the following claims is to be accorded the broadest interpretation so as to encompass all such modifications and equivalent structures and functions. Any one or more of the features or elements hereinabove described may be may be combinable with any another of the features or elements.

The invention claimed is:

1. A self-contained beacon for use in a hand hygiene compliance system to interface with a plurality of wearable monitors in the implementation of an automated hand hygiene compliance protocol, the beacon comprising:

a mountable housing;

an integrated power source; and a transmitter operatively coupled to the power source, the transmitter comprising two or more emitters operatively disposed and divergently angled relative to one another to emit respective transmission beams shaped to bisect a designated attendant travel path to intercept passage of the wearable monitors upon passage along the travel path, wherein the respective transmission beams are configured to overlap to form a combined transmission beam to be substantially uninterrupted at a level of the wearable monitor as the combined transmission beam bisects the path, the transmitter configured to transmit an encoded identifier via the two or more emitters to be received and processed by the wearable monitors upon passage along the travel path for implementation of the automated hand hygiene compliance protocol.

2. The self-contained beacon of claim 1, wherein the combined transmission beam defines a curtain-like beam having a longitudinal beam width along the path that is narrower than a bisecting beam width across the path.

3. The self-contained beacon of claim 1, wherein the integrated power source comprises an accessible battery module for receiving one or more replaceable batteries, and the housing comprises a ceiling mountable base and a removable cover for access to the battery module.

4. The self-contained beacon of claim 1, further comprising a motion sensor configured to detect, and activate the transmitter in response to, an incoming attendant along the path.

5. The self-contained beacon of claim 1, wherein the two or more emitters are configured to emit infra-red (IR) signals.

6. The self-contained beacon of claim 5, wherein the two or more emitters are configured to emit pulse coded signals including the encoded identifier.

7. The self-contained beacon of claim 6, wherein the encoded identifier includes at least one group identifier, with each group identifier being common to a number of beacons.

8. The self-contained beacon of claim 7, wherein the at least one group identifier includes a first group identifier identifying a monitored zone boundary or a second group identifier identifying a non-monitored zone.

9. The self-contained beacon of claim 6, wherein the encoded identifier indicates entry or exit from a monitored zone.

10. A hand hygiene compliance system, comprising a plurality of self-contained beacons, each to interface with a plurality of wearable monitors in the implementation of an automated hand hygiene compliance protocol, each beacon comprising a mountable housing; an integrated power source; and a transmitter operatively coupled to the power source, the transmitter comprising two or more emitters operatively disposed and divergently angled relative to one another to emit respective transmission beams shaped to bisect a designated attendant travel path to intercept passage of the wearable monitors upon passage along the travel path, wherein the respective transmission beams are configured to overlap to form a combined transmission beam, wherein the combined transmission beam is substantially uninterrupted at a level of the wearable monitors as the combined transmission beam bisects the travel path, the transmitter of each of the beacons being operable to transmit an encoded identifier via the two or more emitters to be received and processed by the wearable monitors upon passage along the travel path for implementation of the automated hand hygiene compliance protocol, wherein each of the beacons is independently operable from one another and thus selectively mountable or dismountable in adaptively reconfiguring the hand hygiene compliance system.

11. The system of claim 10, further comprising a plurality of the wearable monitors, each to be worn by an attendant in a facility and including a receiver to receive at least one encoded identifier from at least one of the beacons.

12. The system of claim 11, further comprising a plurality of dispensers operatively mountable within the facility, each of the dispensers comprising an integrated power source and a transmitter operatively coupled thereto to transmit a dispensing signal upon dispenser activation; wherein the wearable monitors are configured to record a hand hygiene action upon receiving the dispensing signal and accordingly update a hand hygiene status stored on the wearable monitors in accordance with the automated hand hygiene compliance protocol.

13. The system of claim 12, wherein each of the dispensers is configured to encode a dispenser identifier in the dispensing signal.

14. The system of claim 13, wherein the dispenser identifier includes a group or type identifier and/or a unique dispenser identifier.

15. The system of claim 10, wherein the combined transmission beam defines a curtain-like beam having a longitudinal beam width along the path that is narrower than a bisecting beam width across the path.

16. The system of claim 15, wherein the integrated power source comprises an accessible battery module for receiving one or more replaceable batteries and wherein the housing comprises a ceiling mountable base and a removable cover removable in providing access to the battery module.

17. The system of claim 15, each beacon further comprising a motion sensor configured to detect, and activate the transmitter in response to, an incoming attendant along the path.

18. The system of claim 10, wherein the plurality of self-contained beacons comprises a plurality of the beacons which are substantially identical, wherein the two or more emitters are fixedly disposed to emit substantially identically shaped divergent combined transmission beams amenable to bisecting a range of attendant travel path widths such that any of the plurality of substantially identical beacons can be used indiscriminately to intercept passage of the wearable monitors across any of the attendant travel path widths.

19. The system of claim 18, wherein the two or more emitters are configured to emit IR signals.

20. The system of claim 19, wherein the two or more emitters are configured to emit pulse coded signals including the encoded identifier.

21. The system of claim 20, wherein the encoded identifier includes at least one group identifier, each group identifier being common to a number of the beacons.

22. The system of claim 21, wherein the at least one group identifier includes a first group identifier to identify a monitored zone or a second group identifier to identify a non-monitored zone.

23. The system of claim 20, wherein each wearable monitor is configured to issue a prompt in real time when receiving the encoded identifier indicating entry to or exit from a monitored zone without receiving the dispensing signal within a set period of time.

24. The system of claim 23, wherein the prompt is selectable and including vibration and/or sound.

25. The system of claim 23, wherein each wearable monitor is configured to disable the prompt either after receiving a dispensing signal from a dispenser or after a set period of time, whichever is sooner.

26. The system of claim 23, wherein the wearable monitors are configured to provide a number of counts or values representing: A) the number of times a zone boundary is crossed without the need for a prompt, B) the number of times a zone boundary is crossed when a dispenser is activated in response to a prompt within a permitted time, and C) the number of times a dispenser is not operated in response to a prompt within the permitted time, wherein the system is configured to measure compliance ratios as (A+B)/(A+B+C).

27. A hand hygiene compliance kit comprising:

at least one self-contained beacon to interface with a plurality of wearable monitors in the implementation of an automated hand hygiene compliance protocol, the at least one self-contained beacon including:

a mountable housing;

an integrated power source;

at least one wearable monitor to be worn by an attendant in a facility, the monitor including a receiver to receive at least one encoded identifier from the self-contained beacon; and a transmitter operatively coupled to the power source, the transmitter comprising two or more emitters operatively disposed and divergently angled relative to one another to emit respective transmission beams shaped to bisect a designated attendant travel path to intercept passage of the wearable monitors upon passage along the travel path, wherein the respective transmission beams are configured to overlap to form a combined transmission beam to be substantially uninterrupted at a level of the wearable monitor as the combined transmission beam bisects the travel path, the transmitter configured to transmit an encoded identifier via the two or more emitters to be received and processed by the wearable monitors upon passage along the travel path for implementation of the automated hand hygiene compliance protocol.

* * * * *